US009330648B2

(12) United States Patent
Matsunaga

(10) Patent No.: US 9,330,648 B2
(45) Date of Patent: May 3, 2016

(54) ELECTRONIC KEYBOARD MUSICAL INSTRUMENT

(71) Applicant: Kabushiki Kaisha Kawai Gakki Seisakusho, Hamamatsu-shi, Shizuoka (JP)

(72) Inventor: Kaoru Matsunaga, Shizuoka (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 0 days.

(21) Appl. No.: 14/609,678

(22) Filed: Jan. 30, 2015

(65) Prior Publication Data

US 2015/0269922 A1 Sep. 24, 2015

(30) Foreign Application Priority Data

Mar. 21, 2014 (JP) ..... 2014-059318

(51) Int. Cl.
*G10H 1/08* (2006.01)
*G10H 7/00* (2006.01)
*G10H 7/04* (2006.01)

(52) U.S. Cl.
CPC . *G10H 7/00* (2013.01); *G10H 1/08* (2013.01); *G10H 7/04* (2013.01)

(58) Field of Classification Search
CPC ..... G10H 7/00; G10H 1/08
See application file for complete search history.

(56) References Cited

U.S. PATENT DOCUMENTS 3,038,363 A * 6/1962 Miessner ..... G10H 1/0535 84/363
3,470,305 A * 9/1969 Martin ..... G10C 3/06 84/723
8,895,831 B2 * 11/2014 Tominaga ..... G10H 5/007 84/600
2001/0027714 A1 * 10/2001 Kondo ..... G10H 1/057 84/615
2007/0175318 A1 * 8/2007 Izumisawa ..... G10H 1/0091 84/626
2007/0221035 A1 * 9/2007 Muramatsu ..... G10F 1/02 84/13
2009/0241756 A1 * 10/2009 Tajima ..... G10H 1/32 84/604
2011/0064233 A1 * 3/2011 Van Buskirk ..... G10H 1/0091 381/61
2012/0174728 A1 * 7/2012 Oh ..... G10C 3/00 84/193
2013/0061734 A1 * 3/2013 Koseki ..... G10H 1/0091 84/189
2013/0092007 A1 * 4/2013 Ohnishi ..... G10C 3/06 84/192

FOREIGN PATENT DOCUMENTS

JP 09127941 A 5/1997
JP 2009282163 B 3/2009

* cited by examiner

*Primary Examiner* — David Warren
(74) *Attorney, Agent, or Firm* — Sughrue Mion, PLLC

(57) ABSTRACT

An electronic keyboard musical instrument includes a storage device, a musical tone generation unit, a resonating sound generation unit, and an adding unit. The musical tone generation unit reads out corresponding musical tone waveform data from the storage device according to key depression information to generate a musical tone waveform signal and a first register resonating sound waveform signal. The resonating sound generation unit receives the musical tone waveform signal to cause the resonating sound generation circuit to generate a second register resonating sound waveform signal according to damper pedal operator manipulation information and the key depression information, and outputs the second register resonating sound waveform signal. The adding unit is configured to add the musical tone waveform signal and the resonating sound waveform signal from the musical tone generation unit and the resonating sound generation unit respectively, and outputting a resulting signal.

4 Claims, 7 Drawing Sheets

ELECTRONIC KEYBOARD MUSICAL INSTRUMENT

BACKGROUND OF THE INVENTION

1. Field of the Invention

The present invention relates to an electronic keyboard musical instrument. Especially the present invention relates to a technique having a preferred resonating sound generation unit for simulating a string resonating sound, which is generated such as when a damper pedal is manipulated in an acoustic piano.

2. Discussion of Background

An acoustic piano has a damper pedal and dampers holding strings. A manipulation of the damper pedal spaces the dampers from the strings. This allows not only an actually-struck string but all the other strings to resonate. Accordingly, such electronic keyboard musical instruments as electronic pianos and electronic organs also require a function to simulate the string resonating sound by the manipulation of the damper pedal.

For example, such electronic keyboard musical instruments employ a method in which these instruments record both a normal piano sound with no manipulation of the damper pedal and a piano sound including a resonating sound under a manipulation of the damper pedal. These instruments store pieces of waveform data of such piano sounds so as to select a suitable piece of waveform data according to the presence/absence of the damper pedal manipulation for generation of a musical tone.

These instruments also use a system in which they record a piano sound including the resonating sound under the manipulation of the damper pedal, remove only a harmonic tone from the recorded piano sound to generate a resonating sound component in order to store its waveform data. These instruments then generate the resonating sound component together with a normal musical tone by using a plurality of channels when the damper pedal is manipulated.

As one of examples, Japanese Unexamined Patent Application Publication No. H09-127941 discloses an electronic keyboard musical instrument including a resonating sound musical tone waveform data memory for storing waveform data of musical tone which represents only a resonating sound of a fundamental tone. This instrument is configured to control amplitude of waveform data which is readout from the resonating sound musical tone waveform data memory in accordance with an instruction by the damper pedal.

Furthermore, there is also a method that rather than generating musical tones based on the pieces of waveform data stored in advance, configures a resonating sound generation unit using a digital signal processor (DSP) to output a signal for generating the resonating sound through the resonating sound generation unit only when the damper pedal is manipulated.

However, the system that uses a plurality of channels to generate the resonating sound component together with the normal musical tone has a problem in that its predetermined number of channels causes sound breaks due to lack of the channels in the case where the number of emitted sounds increases.

On the other hand, the system (the resonating sound generation unit) in which DSP performs arithmetic operations to generate the resonating sound has problems that the necessity of many operations increases the scale of the system, and that, in the case of the resonating sound generation unit with external memories (delay memories) and feedback loops in use, the accurate pitch control becomes complicated in the high register. In other words, DSP often uses the integer arithmetic for a delay amount corresponding to a pitch in order to decrease the arithmetic operations. However, the higher the register becomes, the larger the rounding error becomes. It has emerged as a problem that the accurate pitch control becomes impossible.

The present invention has been made to solve the above-described problems and it is an object of the present invention to provide an electronic keyboard musical instrument capable of generating the resonating sound which allows the accurate pitch control in the high register without sound breaks.

SUMMARY OF THE INVENTION

There is provided an electronic keyboard musical instrument according to an aspect of the invention. The electronic keyboard musical instrument includes a storage device, a musical tone generation unit, a resonating sound generation unit, and an adding unit. The storage device stores musical tone waveform data. The musical tone generation unit is configured to read out corresponding musical tone waveform data from the storage device according to key depression information to generate a musical tone waveform signal and a first register resonating sound waveform signal. The resonating sound generation unit is capable of configuring arbitrary resonating sound generation circuit. The resonating sound generation unit is configured to receive the musical tone waveform signal to cause the resonating sound generation circuit to generate a second register resonating sound waveform signal according to damper pedal operator manipulation information and the key depression information. The resonating sound generation unit is configured to output the second register resonating sound waveform signal. The adding unit is configured to add the musical tone waveform signal and the resonating sound waveform signal from the musical tone generation unit and the resonating sound generation unit respectively, so as to output a resulting signal.

With this configuration, the resonating sound in the high register with no damper pedal effect is generated by reading out the musical tone waveform data in the above-described storage device, and causing the musical tone generation unit to generate a first register resonating sound waveform signal (that is, the first register resonating sound waveform data is included in the musical tone waveform data). On the other hand, the resonating sound in the register other than the high register (middle and low register; a second register) is generated by generating a second register resonating sound waveform signal through the arithmetic operations by the above-described resonating sound generation unit. Consequently, these signals produce a sound.

Advantageous Effects of Invention

With the above-described configuration of the present invention, the resonating sound in the high register with no damper pedal effect is generated by reading out the musical tone waveform data in the above-described storage device, and causing the musical tone generation unit to generate the first register resonating sound waveform signal. On the other hand, the resonating sound in the register other than the high register (middle and low register; the second register) is generated by generating the second register resonating sound waveform signal through the arithmetic operations by the above-described resonating sound generation unit. Consequently, these signals produce a sound. Thus, the configuration can provide higher effects of no channel-number-shortage-induced sound breaks and the accurate pitch control of the high register resonating sound even in the case of the delay amount processing by integer value.

DETAILED DESCRIPTION OF THE PREFERRED EMBODIMENTS

An embodiment of the present invention will be described below by referring to the accompanying drawings.

Figure 2:
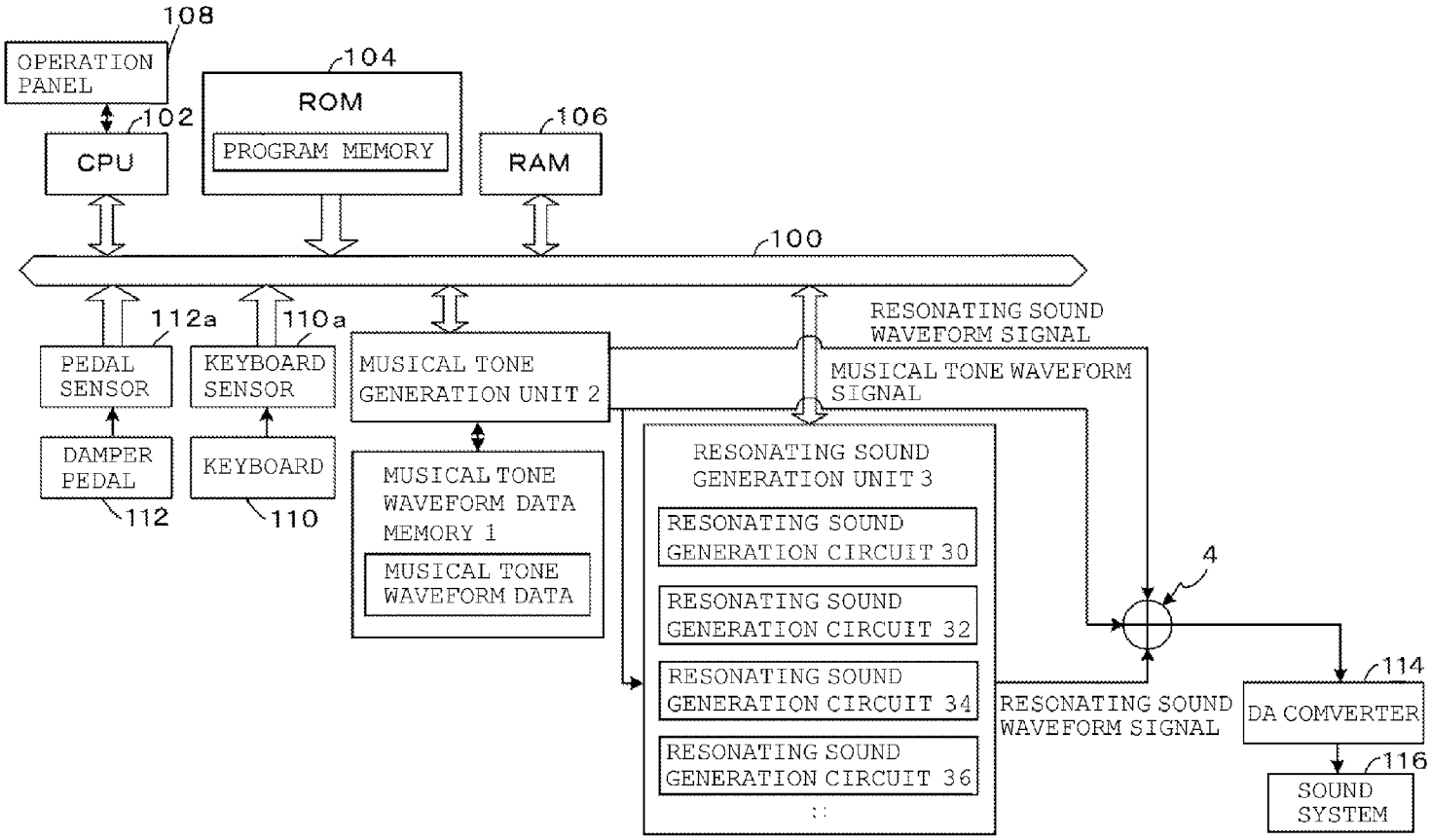
FIG. 2 is a block diagram illustrating an exemplary hardware configuration of the electronic piano, which is the electronic keyboard musical instrument according to one embodiment of the present invention.

FIG. 2 is a block diagram illustrating an exemplary hardware configuration of an electronic piano, which is an electronic keyboard musical instrument according to one embodiment of the present invention. In FIG. 2, a CPU 102 controls respective units illustrated in FIG. 2 via a system bus 100.

A ROM 104 has a program memory 104*a* for storing programs used by the CPU 102 and a data memory (not shown) for storing various kinds of data including at least pieces of timbre data. A RAM 106 temporarily stores various kinds of data generated during the control by the CPU 102.

An electronic piano is provided with an operation panel 108, a keyboard 110, and a damper pedal 112. The operation panel 108 has various state setting switches including timbre switches (not shown) for selecting a timbre of musical tone to be generated. Information set from the operation panel 108 is supplied to the CPU 102.

A manipulation (depression) state of the damper pedal 112 is detected by a pedal sensor 112*a* and is provided to the CPU 102 as pedal operator manipulation information. The pedal sensor 112*a* includes a variable resistor and detects fluctuations in voltage by the resistance value of this variable resistor as a depression amount of the damper pedal 112. Depression amount data of the damper pedal 112 detected by the pedal sensor 112*a* is transmitted to the CPU 102 as the pedal operator manipulation information.

In the case where the CPU 102 receives the depression amount data, which is output from the pedal sensor 112*a*, as the pedal operator manipulation information, the CPU 102 sets coefficients, which are to be transmitted to a resonating sound generation unit 3 described below, in the RAM 106. If the depression of the damper pedal 112 stops, the pedal sensor 112*a* notifies the CPU 102 of a pedal depression amount value as "0". This sets the coefficients in the RAM 106 to the predetermined minimum values. Additionally, the coefficients for resonance setting in the RAM 106 change depending on the pedal depression amount value.

The keyboard 110 of the electronic piano according to this embodiment is constituted of 88 keys, each being provided with a keyboard sensor 110*a* including a touch sensor. The keyboard sensor 110*a* detects the playing operation of the keyboard 110 by the player, and outputs the key depression information such as a key code indicating the pitch of a depressed key, key-on/key-off instructing the sound/silence timing of a musical tone in response to the depression and release of the key, and a key touch corresponding to a depression velocity of the key. The information output from the keyboard sensor 110*a* is supplied to the CPU 102 via the system bus 100.

A musical tone generation unit 2 is a tone generator provided with time-divisionally controlled channels for generating a plurality of tones simultaneously, and accumulates signals from all the plurality of channels to output. The musical tone generation unit 2 performs an allocation of a channel according to a key depression instruction included in the key depression information. Each allocated channel generates a musical tone corresponding to the appropriate key depression information.

A musical tone waveform data memory 1 stores pieces of waveform data of musical tone information (these pieces of data also include pieces of waveform data of resonating sounds in the corresponding high register among respective pieces of waveform data). The musical tone generation unit 2 reads out a piece of waveform data and a piece of waveform data of resonating sound in the high register with no damper pedal effect, both being stored in the musical tone waveform data memory 1. Then, based on the piece of waveform data and the piece of resonating sound waveform data which are read out, the musical tone generation unit 2 generates a musical tone waveform signal and a resonating sound waveform signal in the high register with no damper pedal effect.

The musical tone generation unit 2, in response to a key operation, reads out the musical tone waveform data from the musical tone waveform data memory 1 and generates the musical tone waveform signal. If it is determined that a resonating sound to be emitted exists, the musical tone generation unit 2 simultaneously reads out apiece of resonating sound waveform data in the corresponding high register among respective pieces of waveform data and generates a resonating sound waveform signal. The musical tone generation unit 2 starts to read out the musical tone waveform data of a timbre set by the timbre switch in response to the key-on, and increments the address of the musical tone waveform data memory 1 at a read-out rate corresponding to the key code. That is, the musical tone waveform data is read out at a read-out rate corresponding to the key code. The musical tone generation unit 2 also reads out the resonating sound waveform data at a read-out rate corresponding to the pitch of the resonating sound to be emitted.

The musical tone waveform signal and the resonating sound waveform signal are added to another resonating sound waveform signal by an adding unit 4 described below, converted to an analog signal by a digital analog converter 114, and then input to a sound system 116. The sound system 116 includes an amplifier, a speaker and the like, and generates the output signal of the digital analog converter 114 to emit a sound to the outside as the output of the electronic piano.

A description will be given of a main function of the above-described electronic piano.

The electronic piano according to this embodiment has a function capable of generating a high register resonating sound, which is generated without a manipulation of the damper pedal 112, and a middle and low register resonating sound, which is generated under a manipulation of the damper pedal 112.

In the acoustic piano, if nothing is done, the dampers are pressing the strings. In this case, resonating sounds in the middle and low register are not affected by an impact sound upon a key depression (even in such case, in practice, resonating sounds in that register are slightly output), and only resonating sounds in the high register are generated. In contrast to this, when the damper pedal 112 is manipulated, the dampers separate from the strings. This generates the resonating sounds corresponding to the key especially in the middle and low register due to vibrations including the impact sound upon the key depression.

In order to be able to generate resonating sounds according to such the characteristic of the acoustic piano, this embodiment makes it possible to store a piece of resonating sound waveform data in the corresponding high register among respective pieces of waveform data into the musical tone waveform data memory 1 together with (rather, as part of) an appropriate piece of musical tone waveform data, read out the piece of musical tone waveform data and the piece of resonating sound waveform data in the corresponding high register according to the key depression instruction in disregard of the manipulation state of the damper pedal 112, and then output as a resonating sound waveform signal and a musical tone waveform signal.

As for pieces of resonating sound waveform data in the middle and low register, on the other hand, the resonating sound generation unit 3 receives the musical tone waveform signal, which is output in the manner described above, and the resonance setting coefficients, which are calculated by the CPU 102 and are set in the RAM 106 according to the pedal operator manipulation information, and then outputs the resonating sound waveform signal in the middle and low register.

This resonating sound generation unit 3 is constituted by the digital signal processor (DSP) and, as necessary, causes the CPU 102 to read out a program from the program memory 104*a* in the ROM 104. In this configuration, the resonating sound generation unit 3 has a plurality of resonating sound generation circuits 30, 32, 34, 36, . . . , each including a delay circuit. Coefficients necessary for the arithmetic operations by those delay circuits, or coefficients which the CPU 102 calculates according to the pedal depression amount in the above-mentioned pedal operator manipulation information and stores in the RAM 106, are transmitted to and set in respective delay circuits by the CPU 102 so that each of the circuits can generate a resonating sound to result in outputting a resonating sound waveform signal in the middle and low register.

By referring to FIG. 1, the configuration of a resonating sound generation element according to this embodiment will be described below.

Figure 1:
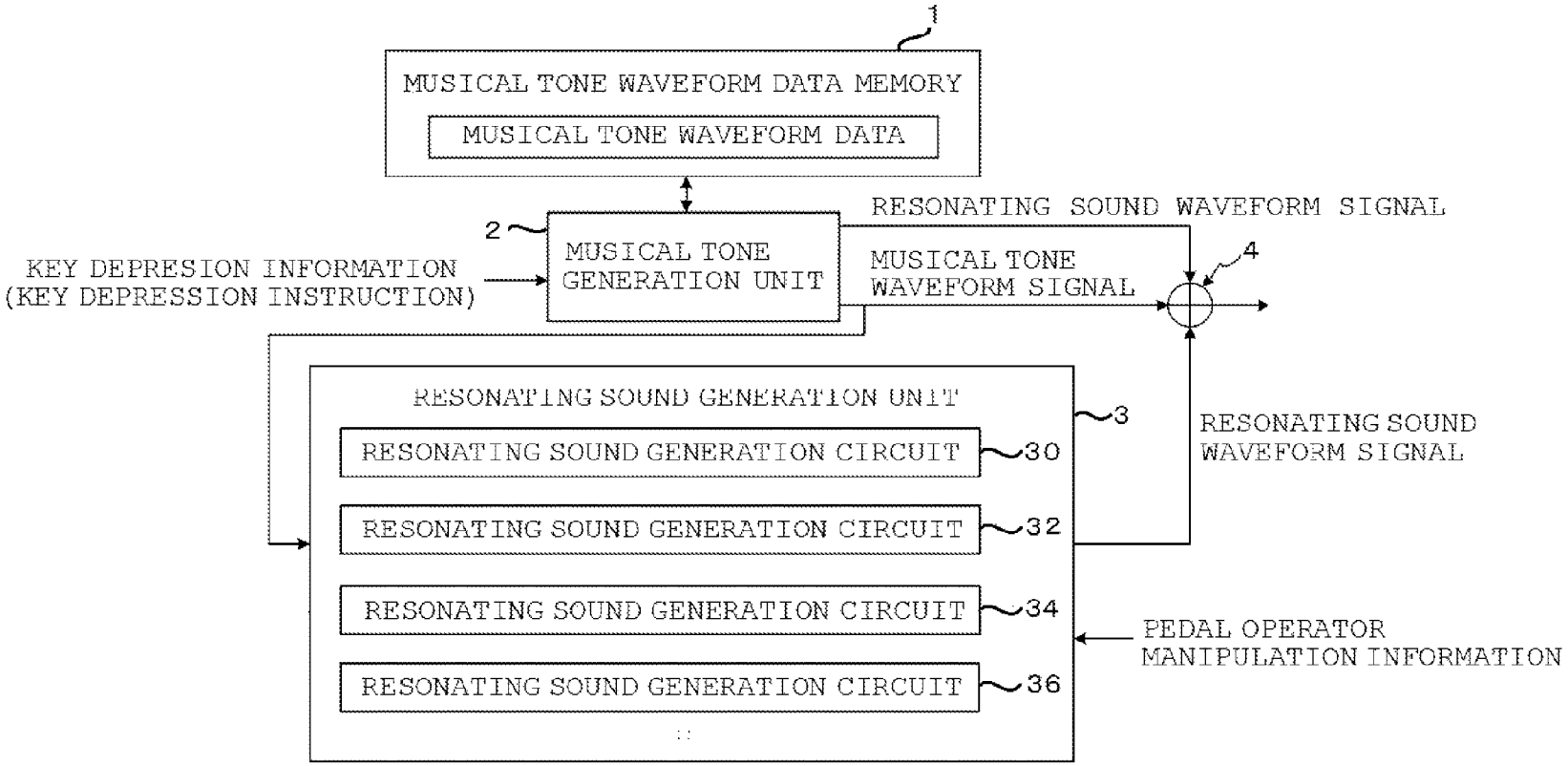
FIG. 1 is a block diagram illustrating a functional configuration according to features of an electronic piano showing one embodiment of an electronic keyboard musical instrument of the present invention.

As illustrated in FIG. 1, the electronic piano of this embodiment includes the musical tone waveform data memory 1 as a storage device among elements in this description, the musical tone generation unit 2, the resonating sound generation unit 3, and the adding unit 4.

As described above, the musical tone waveform data memory 1 stores pieces of waveform data of the musical tone information (these pieces of waveform data also include pieces of resonating sound waveform data in the corresponding high register among respective pieces of waveform data).

The musical tone generation unit 2 reads out a piece of waveform data and a piece of high register resonating sound waveform data with no damper pedal effect from the musical tone waveform data memory 1 and generates a musical tone waveform signal and a high register resonating sound waveform signal with no damper pedal effect based on the piece of waveform data and the piece of resonating sound waveform data which were readout. That is, this musical tone generation unit 2 reads the piece of musical tone waveform data from the musical tone waveform data memory 1 in response to the key operation to generate the musical tone waveform signal, and simultaneously reads the piece of high register resonating sound waveform data in the corresponding high register among respective pieces of waveform data to generate the resonating sound waveform signal.

The resonating sound generation unit 3 is constituted by DSP, and as described above causes the CPU 102 to read out a program from the program memory 104*a* in the ROM 104 as necessary. DSP includes a plurality of resonating sound generation circuits 30, 32, 34, 36 . . . , each including a delay circuit. From the CPU 102, each delay circuit receives a coefficient necessary for its arithmetic operation and sets it. Each delay circuit also receives the musical tone waveform signal from the musical tone generation unit 2. At this time, the CPU 102 calculates the coefficient according to the pedal operator manipulation information from the pedal sensor 112*a*. Thus, the coefficient needed by each delay circuit for the arithmetic operation is changed as necessary, and a resonating sound is generated by each delay circuit. Consequently, resonating sound waveform signals in the middle and low register are output.

The adding unit 4 receives the musical tone waveform signal and the resonating sound waveform signal, which are output from the musical tone generation unit 2, and the middle and low register resonating sound waveform signals output from the resonating sound generation unit 3, and adds these signals to output to the digital analog converter 114.

These added signals are converted to an analog signal by the digital analog converter 114 and then input to the sound system 116 to allow the output signal of the digital analog converter 114 to emit a sound to the outside as the output of the electronic piano.

In the above-described configuration, the resonating sound in the high register with no damper pedal effect is generated by reading out the sound in the above-described musical tone waveform data memory 1 as (handled as identical with) the musical tone waveform data and causing the musical tone generation unit 2 to generate the first register resonating sound waveform signal. On the other hand, the resonating sound in the register other than the high register (middle and low register; the second register) is generated by generating the second register resonating sound waveform signal through the arithmetic operations by the above-described resonating sound generation unit 3. Consequently, these signals produce a sound.

Figure 3:
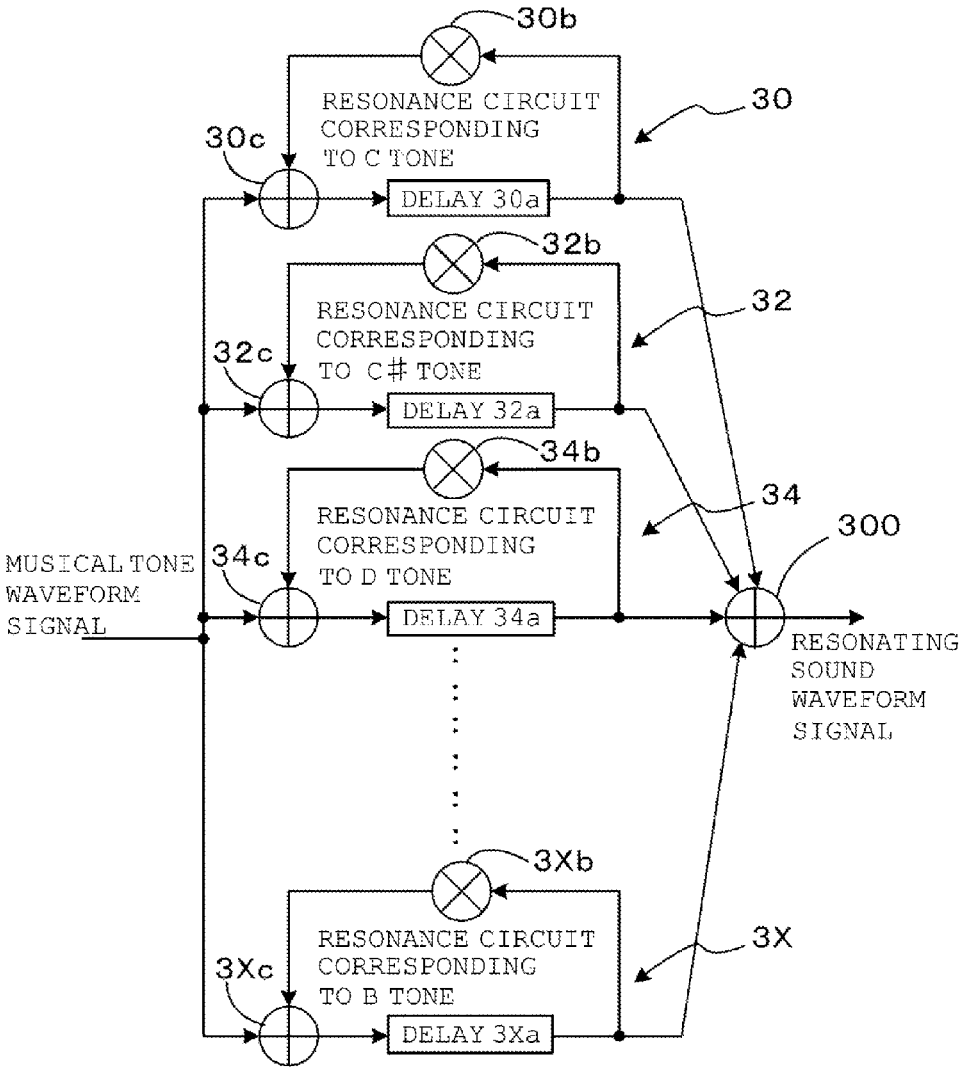
FIG. 3 is a schematic diagram indicating a circuit configuration of the resonating sound generation unit 3.

FIG. 3 is a schematic diagram indicating the circuit configuration of the resonating sound generation unit 3 constituted by DSP.

As illustrated in FIG. 3, respective resonating sound generation circuits 30 to 3X are constituted by delays 30*a* to 3Xa being configured with programs from the program memory in the ROM 104, multipliers 30*b* to 3Xb multiplying the output side of the delays 30*a* to 3Xa by the coefficients from the CPU 102, and adders 30*c* to 3Xc adding the multiplication values to the input side of the delays 30*a* to 3Xa. An adder 300 is also provided to add the outputs from the delays 30*a* to 3Xa. Among such circuit configurations, the resonating sound generation circuit 30 configures the resonance circuit corresponding to the C tone; the resonating sound generation circuit 32 does the resonance circuit corresponding to the C# tone; the resonating sound generation circuit 34 does the resonance circuit corresponding to the D tone; . . . and the resonating sound generation circuit 3X does the resonance circuit corresponding to the B tone.

In the input side of these circuit configurations, as described above, the musical tone waveform signal from the musical tone generation unit 2 is input. On the other hand, in the output side of these circuit configurations, the signals of respective tones—the C tone to the B tone—, which are output after each of the resonating sound generation circuits 30 to 3X multiplies the musical tone waveform signal by the delay, are output.

Figure 4:
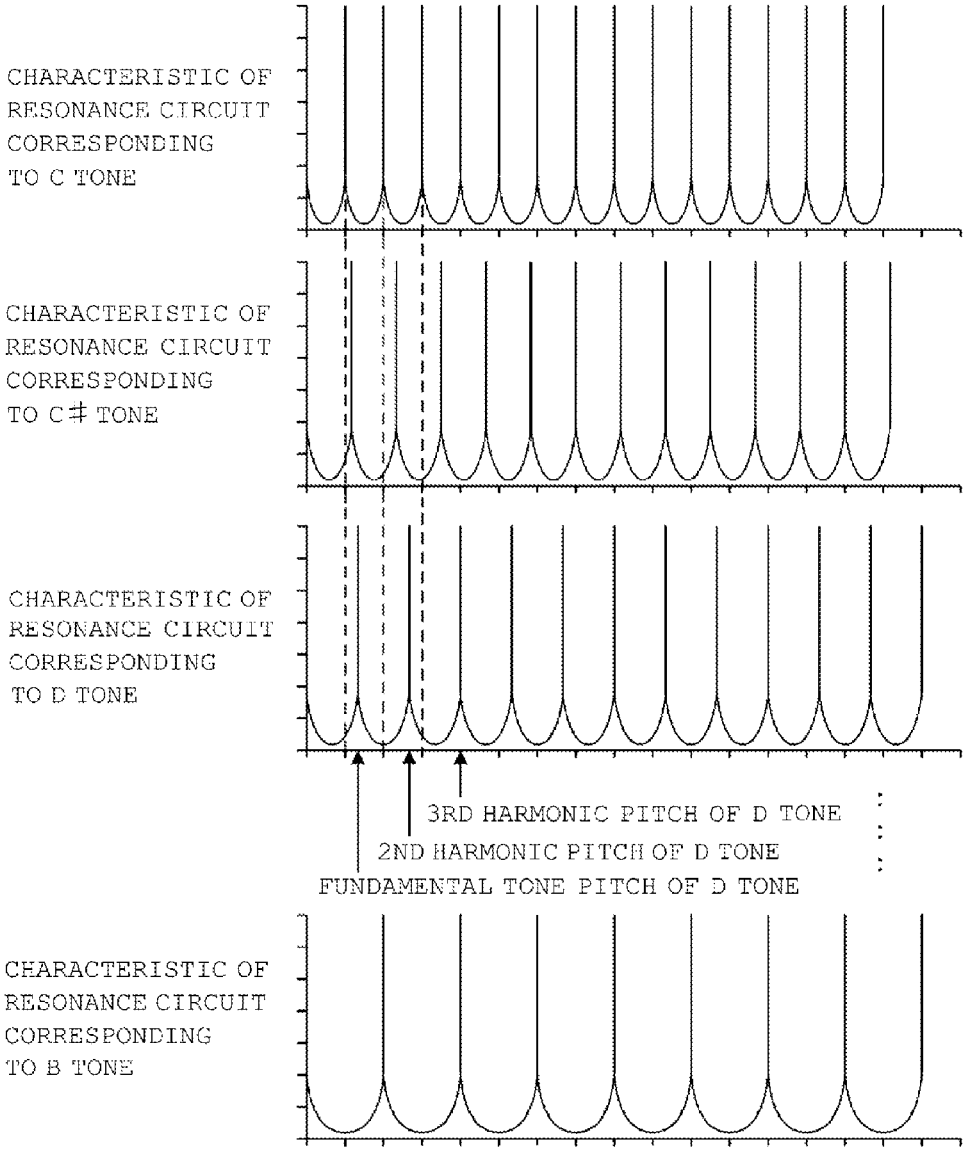
FIG. 4 shows waveform diagrams indicating the characteristics of resonance circuits, each corresponding to the C tone, the C# tone, the D tone, . . . , and the B tone in FIG. 3.

FIG. 4 illustrates the characteristics of the resonance circuits for the C tone, the C# tone, the D tone . . . , and the B tone in FIG. 3, respectively. As illustrated in the figure, these resonating sound waveform signals have a slightly displaced pitch from each other. These displacements just correspond to the resonating sound components in the event that the damper pedal of the acoustic piano is manipulated. These resonating sound waveform signals are finally added by the adder 300, and are output as a single resonating sound waveform signal. As described above, these signals are originally for the resonating sound waveform signal corresponding to the musical tone waveform signal in the middle and low register. The coefficients multiplied by the multipliers 30*b* to 3Xb are the values which the CPU 102 calculates according to the pedal depression amount in the pedal operator manipulation information and stores in the RAM 106 as DSP-processible ones.

Next, the operation of the electronic piano according to this embodiment will be described by referring to the flowcharts in FIG. 5 to FIG. 7.

Figure 5:
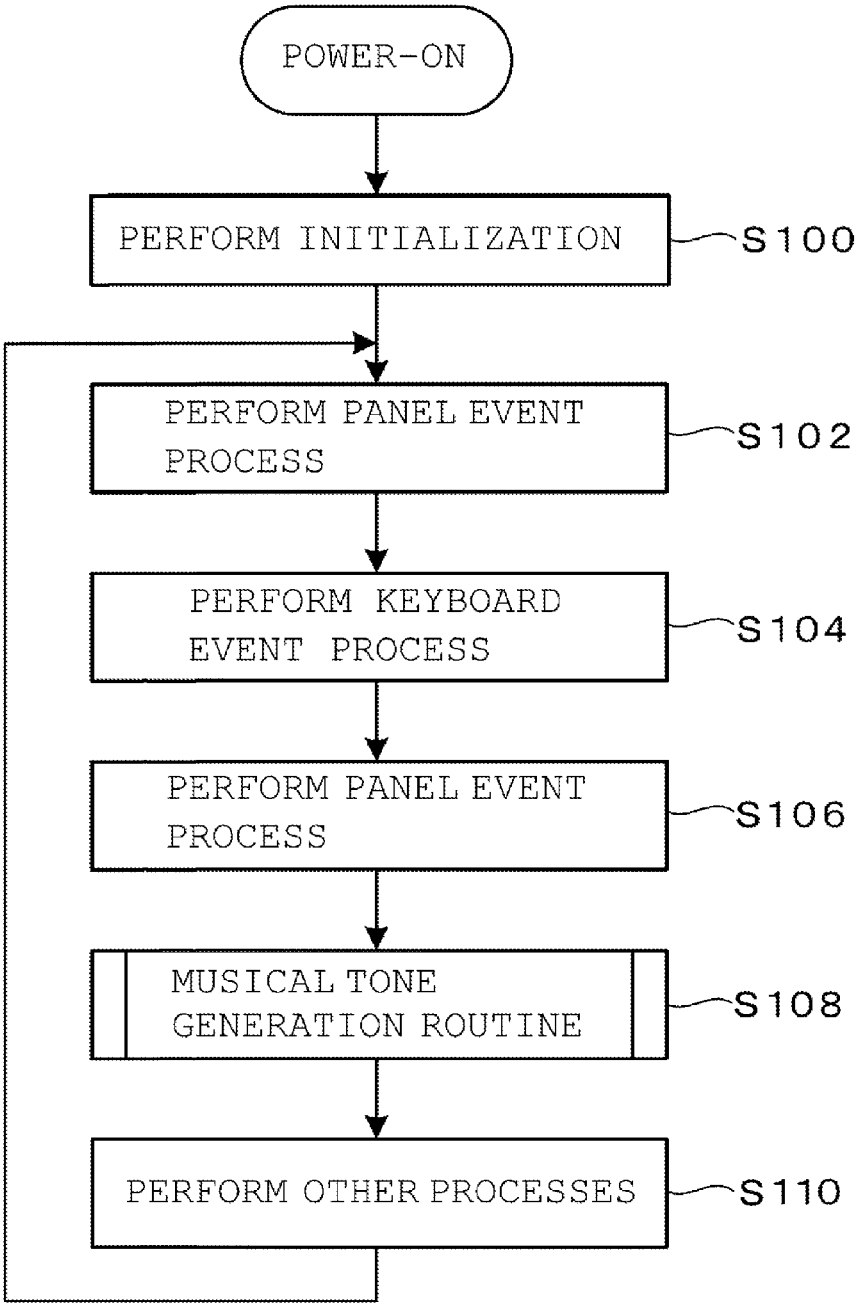
FIG. 5 is a flowchart indicating the main process of the electronic piano.

FIG. 5 indicates a flowchart of a main process of the electronic piano. Upon power-on, the CPU 102, the RAM 106, the resonating sound generation unit 3 (DSP) and others are initialized (step S100).

Next, a panel event process is performed to read the switch state and the like of the operation panel 108 and execute the corresponding processes (step S102). Then, based on the output of the keyboard sensor 110*a*, a keyboard event is executed (step S104).

Furthermore, a pedal event process corresponding to the output of the pedal the pedal sensor 112*a* is executed (step S106). Next, a musical tone generation routine relevant to the musical tone waveform signal and the resonating sound waveform signal is executed (step S108), and finally the other processes are executed (step S110).

Figure 6:
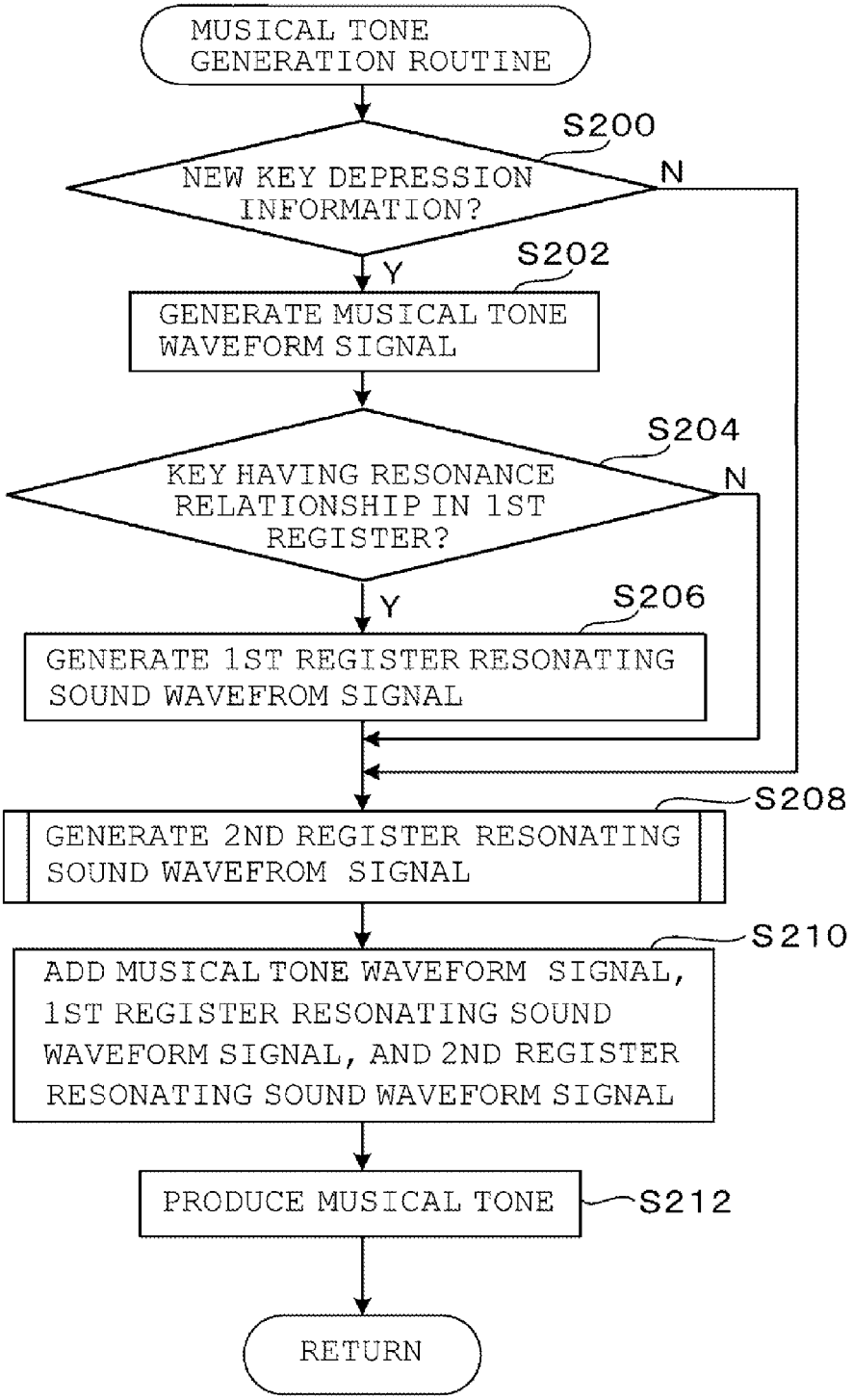
FIG. 6 is a flowchart indicating the detail of the musical tone generation routine in step S108 of FIG. 5.

FIG. 6 is a flowchart indicating the detail of the musical tone generation routine (step S108) in FIG. 5.

First, it is checked whether or not there is new key depression information (step S200). If there is not new key depression information (step S200; N), the process goes to the after-mentioned step S208, or the second resonating sound waveform signal generation routine.

Inversely, if there is new key depression information (step S200; Y), the musical tone generation unit 2 performs the musical tone signal generation process based on the key depression information (step S202).

Then, it is checked whether or not the key code in the key depression information is a key which has the resonance relationship in the first register (step S204). If the key code is a key having the resonance relationship in the first register (step S204; Y), the musical tone generation unit 2 reads out the first register (the high register) resonating sound waveform data from the musical tone waveform data memory 1 to generate a first register resonating sound waveform signal (step S206).

Even if the key code is not a key having a resonance relationship in the first register (step S204; N) or if the first register resonating sound waveform signal is generated (step S206), the resonating sound generation unit 3 generates a second register resonating sound waveform signal (step S208). As described above, even if there is no new key depression information in step S200 (step S200; N), the second register resonating sound waveform signal is generated (step S208).

Next, the adding unit 4 adds the musical tone waveform signal, the first register resonating sound waveform signal and the second register resonating sound waveform signal in a given balance (step S210), and the sound production process of the added musical tone signals is performed (step S212). Then, the process goes back to the other processes in FIG. 5 (step S110).

Figure 7:
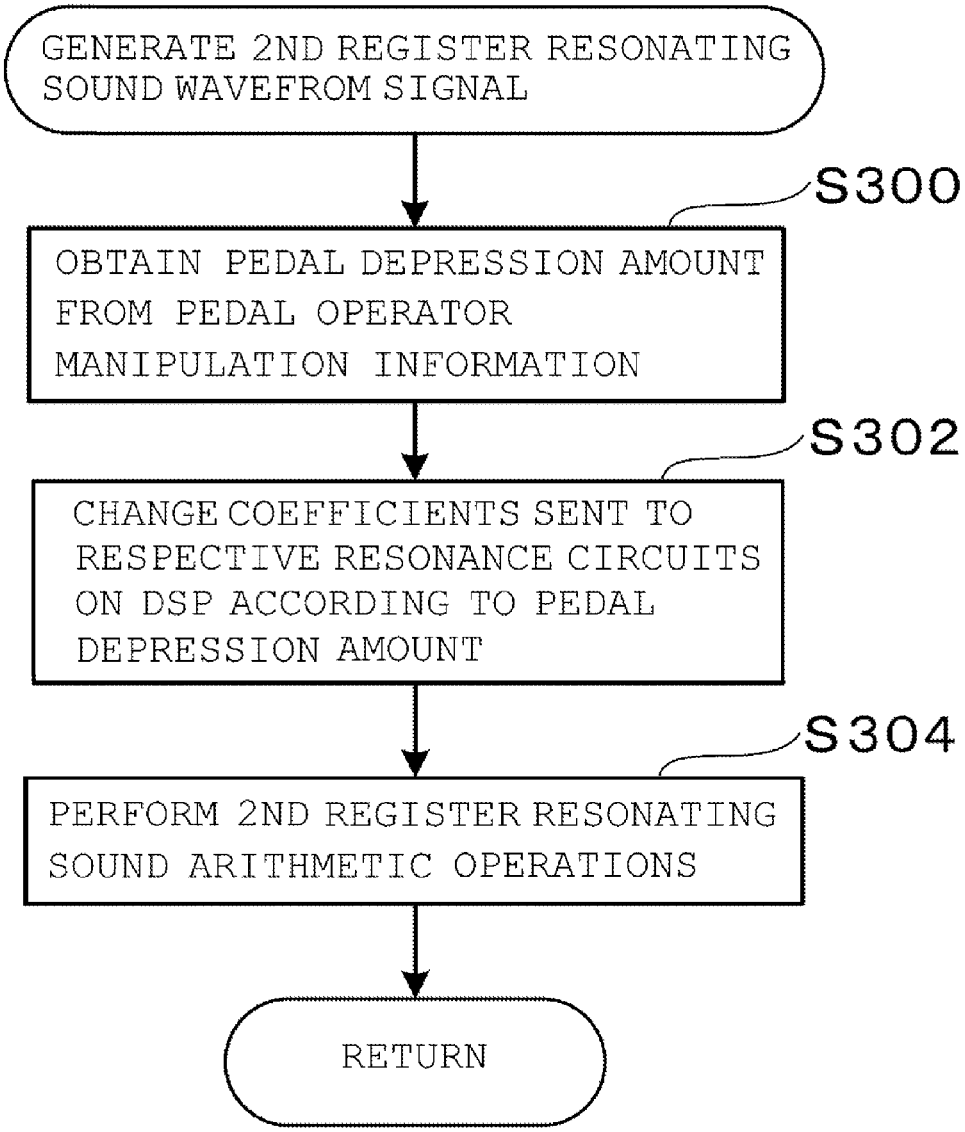
FIG. 7 is a flowchart indicating the detail of the second register resonating sound waveform signal generation routine in step S208 of FIG. 6.

FIG. 7 is a flowchart indicating the detail of the second register resonating sound waveform signal generation routine in step S208 of FIG. 6.

First, the CPU 102 receives the pedal operator manipulation information from the pedal sensor 112*a* and obtains the pedal depression amount from the information (step S300).

According to the obtained pedal depression amount, the CPU 102 selects coefficients, which are calculated by the CPU 102 and stored in the RAM 106, and transmits them to the respective multipliers 30*b* to 3Xb on the resonating sound generation circuits 30 to 3X in the resonating sound generation unit 3 for a setting change (step S302). Then, each of the resonating sound generation circuits 30 to 3X generates a resonating sound. Eventually, the resonating sound generation unit 3 outputs the second register (middle and low register) resonating sound waveform signal (step S304). Then, the process goes back to step S210 of FIG. 6 where the adding unit 4 adds the musical tone waveform signal, the first register resonating sound waveform signal, and the second register resonating sound waveform signal in a given balance.

In the electronic piano according to the above-detailed embodiment, the resonating sound in the first register (the high register) with no effect of the damper pedal 112 is produced in a manner to read out the musical tone waveform data from the musical tone waveform data memory 1, and then cause the musical tone generation unit 2 to generate the first register resonating sound waveform signal together with the musical tone waveform signal corresponding to the key code of the pressed key. On the other hand, the resonating sound in the other register (the middle and low register; the second register) is produced in a manner to generate the second register resonating sound waveform signal through the arithmetic operations by the aforementioned resonating sound generation unit 3, and then cause the adding unit 4 to add the musical tone waveform signal and the resonating sound waveform signal. Accordingly, the channel-number-shortage-induced sound breaks do not occur and the accurate pitch control of resonating sound in the high register becomes possible even when the delay amount is processed in an integer value for the pitch control.

The electronic keyboard musical instrument of the present invention is not limited to the aforementioned electronic piano, and various modifications and changes of the embodiments may be made without departing from the gist of the invention.

The electronic keyboard musical instrument of the present invention finds applications not only in the electronic piano but also in electronic organs, digital synthesizers and modeling synthesizers.

The entire disclosure of Japanese Patent Application No. 2014-059318, filed on Mar. 21, 2014 including specification, claims, drawings and summary, is incorporated herein by reference in its entirety.

What is claimed is:

1. An electronic keyboard musical instrument, comprising:

a storage device that stores musical tone waveform data;

a musical tone generation unit configured to read out corresponding musical tone waveform data from the storage device according to key depression information to generate a musical tone waveform signal and a first register resonating sound waveform signal;

a resonating sound generation unit capable of configuring arbitrary resonating sound generation circuit, the resonating sound generation unit being configured to receive the musical tone waveform signal to cause the resonating sound generation circuit to generate a second register resonating sound waveform signal according to damper pedal operator manipulation information and the key depression information, the resonating sound generation unit being configured to output the second register resonating sound waveform signal; and an adding unit configured to add the musical tone waveform signal and the resonating sound waveform signal from the musical tone generation unit and the resonating sound generation unit respectively, so as to output a resulting signal.

2. A non-transitory computer-readable recording medium storing a control program for controlling an electronic keyboard musical instrument, the control program causing the electronic keyboard musical instrument to function as:

a storage device that stores musical tone waveform data;

a musical tone generation unit configured to read out corresponding musical tone waveform data from the storage device according to key depression information to generate a musical tone waveform signal and a first register resonating sound waveform signal;

a resonating sound generation unit capable of configuring arbitrary resonating sound generation circuit, the resonating sound generation unit being configured to receive the musical tone waveform signal to cause the resonating sound generation circuit to generate a second register resonating sound waveform signal according to damper pedal operator manipulation information and the key depression information, the resonating sound generation unit being configured to output the second register resonating sound waveform signal; and an adding unit configured to add the musical tone waveform signal and the resonating sound waveform signal from the musical tone generation unit and the resonating sound generation unit respectively, so as to output a resulting signal.

3. The electronic keyboard musical instrument according to claim 1, wherein the first register resonating sound waveform signal is a resonating sound waveform signal in high register without damper pedal effect, and the second register resonating sound waveform signal is a resonating sound waveform signal in middle and low register lower than the resonating sound waveform signal in high register.

4. The electronic keyboard musical instrument according to claim 2, wherein the first register resonating sound waveform signal is a resonating sound waveform signal in high register without damper pedal effect, and the second register resonating sound waveform signal is a resonating sound waveform signal in middle and low register lower than the resonating sound waveform signal in high register.

* * * * *